United States Patent [19]

Grose

[11] 4,274,916

[45] Jun. 23, 1981

[54] DIMENSIONALLY STABLE BACKING MATERIALS FOR SURFACE COVERINGS AND METHODS OF MAKING THE SAME

[75] Inventor: Reginald E. Grose, Westminster, Md.

[73] Assignee: Congoleum Corporation, Kearny, N.J.

[21] Appl. No.: 80,908

[22] Filed: Oct. 1, 1979

[51] Int. Cl.[3] ..... D21F 11/00

[52] U.S. Cl. ..... 162/145; 162/183

[58] Field of Search ..... 162/145, 146, 156, 168 NA, 162/168 N, 181 R, 183; 428/280, 281, 285, 288, 297, 299, 302, 327

[56] References Cited

FOREIGN PATENT DOCUMENTS 2357676 5/1978 France .

*Primary Examiner*—James J. Bell

*Attorney, Agent, or Firm*—Richard T. Laughlin

[57] ABSTRACT

A surface covering comprising: one or more layers of the same or different resinous polymeric compositions; and a dimensionally stable fibrous backing material in adhering contact therewith comprising: from about 30% by weight to about 77% by weight of selected proportions of overlapping, intersecting and intermatted polypropylene fibers, glass fibers and wood pulp fibers; from about 0.2% to about 2% by weight of a stable, water-soluble, cationic, quaternary modified acrylamide polymer having a high charge density of from about 350 to about 600 or more milliequivalents/-milligram of unit weight and a very high molecular weight of from about 3 million to about 8 million or more; from about 15% to about 60% by weight of a filler or loading agent; and from about 7% to about 27% by weight of a synthetic resinous polymeric binder, all percentages being based on the total weight of the dimensionally stable fibrous backing material. The disclosure also relates to methods of making such surface coverings comprising such a layer or layers of resinous polymeric compositions and such dimensionally stable fibrous backing materials.

19 Claims, No Drawings

DIMENSIONALLY STABLE BACKING MATERIALS FOR SURFACE COVERINGS AND METHODS OF MAKING THE SAME

FIELD OF THE INVENTION

The present invention relates to surface coverings comprising one or more layers of the same or different resinous polymeric compositions and a dimensionally stable fibrous backing material in adhering contact therewith, and to methods of making such surface coverings.

BACKGROUND OF THE INVENTION

Surface coverings, notably floor, wall and ceiling coverings, or desk, table and counter tops, or the like, have been made for many years and presently normally comprise one or more layers of the same or different resinous polymeric compositions, usually polyvinyl chloride homopolymers or copolymers, or polyurethane resins, or the like, and a relatively dimensionally stable fibrous backing material therefor, normally comprising a felted or matted fibrous sheet of asbestos or cellulosic fibers which may be impregnated with water-resisting and/or strengthening materials.

Such a surface covering must be dimensionally stable under various atmospheric conditions and under varying moisture situations. For example, if such a surface covering was intended to be cemented to a floor or other substrate by means of a water-soluble paste or adhesive and the fibrous backing material was susceptible to various dimensional changes upon exposure to moisture-or water-containing materials, it would change dimensions and would normally expand upon being contacted by the water-soluble paste or adhesive, or upon exposure to varying moisture conditions and situations. However, on the other hand, the resinous polymeric compositions on top of the fibrous backing materials would either not expand at all or else would change dimensions to a different degree, whereby the surface covering would undesirably buckle or curl upwardly, particularly where adjacent pieces of the surface covering were fitted or joined together.

It is additionally also important that such fibrous backing materials also be dimensionally stable under varying temperature conditions and situations, particularly during further manufacturing processing and finishing of the surface covering under elevated conditions of temperature.

PRINCIPAL PURPOSE AND OBJECT OF THE INVENTION

It is therefore a principal purpose and object of the present invention to provide a surface covering comprising one or more layers of the same or different resinous polymeric compositions and a dimensionally stable fibrous backing material in adhering contact therwith, in which, during normal manufacturing processing and finishing conditions as well as in subsequent domestic and/or commercial use, the surface covering does not tend to buckle or to curl upwardly, particularly where adjacent pieces of the surface covering are fitted or joined together.

A BRIEF SUMMARY OF THE INVENTION

It has been found that such principal purpose and object of the present invention, as well as other principal purposes and objects to be described herinafter, may be achieved by providing the layer or layers of resinous polymeric compositions with a dimensionally stable fibrous backing material comprising: from about 30% by weight to about 77% by weight of specified proportions of overlapping, intersecting and intermatted polypropylene fibers, glass fibers and wood pulp fibers; from about 0.2% to about 2% by weight of a stable, water soluble, cationic, quaternary modified acrylamide polymer having a high charge density of from about 350 to about 600 or more milliequivalents/milligram of unit weight and a molecular weight of from about 3 million to about 8 million or more; from about 15% by weight to about 60% by weight of calcium carbonate; and from about 7% by weight to about 27% by weight of a synthetic resinous polymeric binder, all percentages being based on the total weight of the dimensionally stable fibrous backing material. The invention also relates to methods of making such surface coverings comprising such a layer or layers of resinous polymeric compositions and such dimensionally stable fibrous backing materials involving a special pretreatment of the water or other aqueous medium in which the polypropylene fibers, the wood pulp fibers and the glass fibers are slurried to form a substantially uniform homogenous material.

THE LAYER OR LAYER OF RESINOUS POLYMERIC COMPOSITIONS

The specific chemical nature or the physical properties and/or characteristics of the particular layer or layes of resinous polymeric compositions used in the application of the principles of the present invention do not relate to the essence of the inventive concept and substantially any resinous polymeric composition known to the art will suffice. However, for the purpose of illustrating the present invention, polyvinyl chloride resin compositions are preferred and typical and will be used but such is primarily exemplary and is not to be construed as limitative of the broader aspects of the present invention.

Methods of preparing such a layer or layers of polyvinyl chloride resin compositions are well described in detail in the prior art, such as noted in U.S. Pat. Nos. 3,293,094 and 3,293,108 to Nairn et al. and reference thereto is incorporated herein. It is also to be noted that such patents make reference to many other resinous polymeric compositions which are also suitable for use within the scope of the present invention.

THE FIBROUS BACKING MATERIAL

The Fibers

The fibers contained in the fibrous backing material of the present invention are derived from three basic sources:

1. Polypropylene fibers;
2. glass fibers; and
3. wood pulp fibers.

The total amount of all of these fibers in the fibrous backing material is in the range of from about 30% by weight to about 77% by weight, based on the total weight of the fibrous backing material. Preferably, however, the total amount of all of these fibers in the fibrous backing material is in the range of from about 40% by weight to about 75% by weight.

THE POLYPROPYLENE FIBERS

The polypropylene fibers used in the application of the principles of the present invention are anionic, hydrophilic and also hydrofelting by nature. They have tensile strengths normally in the range of from about 3000 pounds per square inch up to about 5000 pounds per square inch, or higher. They have average lengths of from about 0.03 inch to about 0.1 inch, and preferably from about 0.04 inch to about 0.06 inch, with average length/diameter ratios of at least about 100/1 to about 120/1. Their average specific gravity is approximately 0.90–0.91 and their melting point range is from about 310° F. to about 330° F.

The total amount of such polypropylene fibers in the fibrous backing material is in the range of from about 17% by weight to about 34% by weight, with optimum results being obtained at from about 19% by weight to about 25% by weight, based on the total weight of the fibrous backing material.

THE GLASS FIBERS

The glass fibers used in the application of the principles of the present invention are substantially neutral in surface electrical charge, do not absorb any moisture or water, have very high tensile strengths, very high densities, and have excellent dimensional stability. They preferably have average lengths of from about 0.1 inch to about 0.7 inch and have average thicknesses or diameters normally in the range of from about 0.00035 inch to about 0.0004 inch.

The total amount of the glass fibers in the fibrous backing material is in the range of from about 6% by weight to about 23% by weight, with optimum results being obtained at from about 9% by weight to about 11% by weight, based on the total weight of the fibrous backing material.

THE WOOD PULP FIBERS

The wood pulp fibers used in the application of the principles of the present invention are anionic and are preferably of the semi-bleached softwood pulp variety derived from conifers such as spruce, pine, hemlock, fir, redwood, cedar, etc. They have lengths of from about 0.05 inch to about 0.2 inch, with length/width ratios on the order to about 100/1 or more.

Although softwood pulp fibers are preferred, hardwood pulp fibers derived from deciduous trees are also utilizable within the scope of the present invention, where their shorter length is not objectionable or where greater opacity or a smoother surface is to be desired or required. Also, although semi-bleached wood pulp fibers are preferred, unbleached or fully bleached wood pulp fibers are also of use, where their appearance and cost is either not objectionable or may be desired or required. And, although wood pulp fibers derived from the kraft or sulfate process are preferred, wood pulp fibers derived from other processes, such as the sulfite process, or the soda process, etc., are also of use.

The total amount of the wood pulp fibers in the fibrous backing material is in the range of from about 20% by weight to about 39% by weight, with optimum results being obtained in the range of from about 22% to about 30% by weight, based on the total weight of the fibrous backing material.

THE FORMATION OF THE FIBROUS BACKING MATERIAL

General Discussion

If the polypropylene fibers, the wood pulp fibers and the glass fibers were to be conventionally charged into water or another aqueous medium in a hydrapulper or a slurry formation tank by standard charging procedures in an effort to form a substantially uniform and homogeneous aqueous slurry of such fibers, it is to be noted that clots and clumps of fibers, notably the glass fibers, undesirably tend to form, along with a tendency to form tangles and to rope together, thereby creating an unsatisfactory, non-uniform and non-homogeneous aqueous fibrous slurry. Subsequent efforts to dissolve, disperse, or to eliminate such glass or other fiber clots, clumps or tangles and rope are usually fruitless and to no avail. As a result, if such a non-uniform and non-homogeneous aqueous fiber slurry were to be further processed into sheet material, for example, the resulting product would be found to be a non-uniform, non-homogeneous unsatisfactory product.

It has been discovered that a proper pretreatment of the slurrying water or other aqueous medium, prior to the charging of the fibers thereto, will prevent the undesirable formation of the clots, clumps, tangles and rope and thus provide for the formation of a desirable uniform, homogeneous sheet material or like product which is found to be dimensionally stable under varying moisture, water and temperature conditions and situations.

THE PRETREATMENT OF THE WATER

Inasmuch as the polypropylene fibers and the wood pulp fibers basically have an anionic surface charge, with the glass fibers being essentially neutral in surfce charge, a relatively strong anionic charge would be developed if such fibers were to be conventionally charged by standard procedures into the water in the slurry formation tank or hydropulper. Such an anionic environment is not suitable for the proper dispersion, especially of the glass fibers in the water and they immediately clot and clump and form tangles and rope undesirably. It is therefore necessary to properly prepare the water in the slurry formation tank or hydropulper before the addition of the fibers thereto. This is done, according to the present invention, by the prior pre-calculated addition to the water of a predetermined small amount of a cationic material of suitable high density charge and suitable electrical surface charge properties and characteristics and sufficiently high molecular weight so as to create a pre-existing cationic charge condition in the water which is capable of sufficiently reducing or completely neutralizing the degree of the anionic charge which is developed by the addition of the polypropylene fibers and the wood pulp fibers.

THE CATIONIC MATERIAL

The cationic material which is found to be suitable for carrying out such a purpose and object is a stable, water soluble, cationic, quaternary modified acrylamide polymer having a high charge density of from about 350 to about 600 or more milliequivalents/milligram of unit weight and a molecular weight in the range of from about 3 million to about 8 million or more, as determined by the intrinsic viscosity method. Methods of making such stable, water soluble, cationic, quaternary modified acrylamide polymers are to be found in the prior art, such as, for example, U. S. Pat. No. 4,010,131 to Phillips et al.

Briefly, such a patent discloses the making of stable, water-soluble, cationic, quaternary modified acrylamide polymers by Mannich-type reactions of polyacrylamide with formaldehyde and aliphatic, aromatic or cyclic branched or straight-chain secondary amines, such as dimethylamine preferably, followed by a quaternization with an alkylating agent such as an alkyl halide, such as methyl iodide or ethyl chloride, preferably.

The principles of the present invention are not limited to the use of polyacrylamides as homopolymers but are also applicable to the use of polyacrylamides as copolymers with other co-polymerable materials or monomers such as dimethylaminoethylacrylate, dimethylaminoethylmethacrylate, diethylaminoethylmethacrylate, diethylaminoethylacrylate, and the like, wherein the resulting co-polymeric polyacrylamide is directly quaternized by dialkyl compounds such as dimethyl sulfate preferably, to form the stable, water-soluble, cationic, quaternary modified acrylamide polymer.

The amount of such cationic material to be added to the slurrying water in the slurry formation tank or hydropulper, prior to the addition of the fibers thereto, varies according to the amount and the specific type of polypropylene fibers and wood pulp fibers which are used and which tend to develop the anionic charge in the water. Within the scope of the present invention, such amount of the cationic material has been determined to be in the range of from about 0.2% by weight to about 2% by weight, based on the total weight of the fibrous backing material, with optimum results being obtained in the range of from about 0.3% by weight up to about 0.7% by weight, again based on the total weight of the fibrous backing material. Such percentage values are helpful in describing the present invention from a product viewpoint. However, from a method viewpoint, it is more helpful to describe the perentage values of the cationic material in terms of the amount of slurrying water to which it is added. Within the broader scope of the present invention, it has been found that from about 0.01% by weight to about 0.3% by weight, and preferably from about 0.03% by weight to about 0.15% by weight, of the cationic material, based on the weight of the slurrying eater, is normally employed.

After the cationic material has been added to the slurrying water with thorough mixing and agitation to insure a substantially uniform, homogeneous dispersion of such cationic material and the proper cationic conditions, the additional materials to be included in the fibrous backing material are then charged to the slurrying tank or hydropulper with thorough mixing in the following preferred order. However, it is to be appreciated that such sequence of addition is preferred and typical and that other sequences of addition of the additional materials are employable.

WET STRENGTH RESINS

Wet strength resins are desirably added to the slurrying water in order to improve the tensile properties of the fibrous backing material. The particlular or specific wet strength resin or resins or the deposition of retention aids which are added to the properly pre-treated slurrying water do not relate to the essence of the present invention. It is sufficient that the specific wet strength resin or the deposition or retention aid which is selected has the proper physical and chemical properties and characteristics to be satisfactorily subsequently absorbed by the wood pulp fibers and, after the fibrous backing material is formed, heated and dried to be converted to an insoluble, thermoset form, creating the necessary cross-linkages and water-resistant bonds between the individual wood pulp fibers.

Specific examples of particular wet and dry strength resins and deposition or retention aids include, as illustrative but not limitative, the following: Amercian Cyanamid "Accostrength" and "Melostrength" melamine-formaldehyde resins; Hercules "Hercobond" and "Kymene" resins; "Rezosol" and "Reten" resins; polymerizable polyfunctional N-methylol compounds, notably N-methylol ureas such as dimethylol urea, N-methulol melamines such as hexamethylol melamine, etc.

The amount of such wet and dry strength resins and deposition or retention aids which are added to the water in the slurrying tank varies primarily according to the amount and the type of wood pulp fibers which are employed in the fiber blend. Within the scope of the present invention, such amount has been found to be from about 1% to about 7% by weight, based on the total weight of the fibrous backing material. The amounts to be employed at this time are preferably such that only a portion of the wood pulp are capable of being cross-linked as a result of the amounts used in the addition at this time. It is also to be appreciated that a mixture or blend of two or more wet and dry strength resins and/or deposition or retention aids may be used and that such a mixture or blend may include both cationic and anionic materials in any desired or required proportions.

THE FILLER OR LOADING AGENT

Also added to the water in the slurrying hydropulper, along with the previously described materials, are other conventional and well-known improvement additives and agents, notably a specified amount of a filler or loading agent, such as calcium carbonate, clay, calcium sulfate, hydrated silica, or the like.

The amount added of such a filler or loading agent varies, depending upon many factors, such as, for example, the specific and particular filler or loading agent which is used, upon the amount and the type of the fibers used in the fibrous backing material, upon the subsequent purpose and proposed use of the fibrous backing material or the surface covering to which it may be applied, and so forth. Within the broader scope of the present invention, such amount of filler or loading agent has been determined to be in the range of from about 15% by weight to about 60% by weight, and preferably from about 20% by weight to about 45% by weight, based on the total weight of the fibrous backing material.

The degree of fineness of the average particle size of such filler or loading agent, such as calcium carbonate, will vary according to the subsequent purpose and use of the fibrous backing material and the surface covering. Within the broader scope of the present invention, the filler or loading agent should be sufficiently fine as to substantially completely pass through a No. 200 mesh screen (74 microns) and preferably also through a No. 325 mesh screen (44 microns) and most desirably through a No. 400 mesh screen (37 microns).

Thus far, the amounts and percentages of the various fibers and the amounts and percentages of the filler or loading agent have been defined in terms of their amounts and percentages in the final product, that is, the total weight of the fibrous backing material. This is excellent when product considerations are involved. Definition in terms of the amounts and percentages, based on the weight of the slurrying water would facilitate the method or procedural considerations of the present inventive concept.

The total amount or percentage of all fibers added to the slurrying water is in the consistency range of from about 1% to about 16%, and preferably from about 1½% to about 8%, based on the weight of the slurrying water. In the same way, the total amount or percentage of the filler or loading agent added to the slurrying water is in the range of from about ½% to about 9%, and preferably from about 1% to about 6%, again based on the weight of the slurrying water.

After the fibers and the wet and dry strength resins and deposition or retention aids and the filler or loading agent have been added to the cationically charged water in the slurrying tank, along with any other desired or required improvement agents or additives, through mixing and agitation are continued to insure uniformity and homogenity of the fiber slurry and the materials deposited thereon.

THE DROP CHEST

The slurry is then transferred to a drop chest, whereat additional wet and dry strength resins and other additives may be charged thereto. Also, additional water may be charged at this time in order to reduce the consistency which, commercially, is in the range of from about 3% to about 5% down to a lower range of from about 2% to about 4%. The amount of wet and dry strength resin is primarily intended to complete the cross-linking of the cellilose wood pulp at their carboxyl and hydroxyl sites which are still available for cross-linking. Within the scope of the present invention, it has been found that the amount of such additional wet and dry strength resin depends primarily upon the amount of the wood pulp fibers present in the fiber blend and upon the strength and effect of the wet and dry strength resins previously charged in the slurrying hydropulper. Such amount to be added in the drop chest has been found to be normally in the range of from about 1½% by weight to about 5% by weight, and preferably from about 2% by weight to about 3% by weight, based on the total weight of the fibrous backing material.

Preferably, a highly cationic wet and dry strength resin is selected from the previously cited wet and dry strength resins in order to create a favorable, highly cationic environment which is well suited for the satisfactory acceptivity and proper deposition on the fibrous materials of an anionic, synthetic resinous latex binder material or synthetic rubber to be added subsequently to bond the fibrous backing material together. Such addition of an anionic, synthetic resinous latex binder material or synthetic rubber takes place in a separate precipitation tank to which the fiber slurry is now transferred.

THE PRECIPITATION TANK

Additional water may now be added with agitation and stirring to adjust the fiber slurry consistency to a desired level and an anionic binder material is added with continued agitation and stirring to insure a uniform precipitation of such binder on the fibers. The consistency in the precipitation tank is preferably in the range of from about 2% to about 4%, and most desirably from about 2½% to about 3½%.

THE LATEX BINDER

The particular on specific anionic, synthetic resinous latex binder material or synthetic rubber which is used does not relate to the essence of the present invention, provided it is capable of ready preparation and convenient use at a desired or required percentage concentration of solids content and is capable of being precipitated on the fibrous materials uniformly and homogeneously in a reasonable period of time. It should be observed that, after the addition of the latex binder material and after mixing and agitation for a reasonably short time, the supernatant liquid should become relatively clear, thus indicating that the precipitation of the resinous binder material on the fibrous materials is substantially complete.

Specific examples of suitable binder materials include, as illustrative but not limitative, the following: the styrene butadiene (SBR) latices, the neoprene latices, the acrylic latices, the acrylonitrile butadiene latices, the polybutadiene latices, the carboxylated styreene butadiene and other latices, the polyvinyl chloride and polyvinyl acetate latices, etc. Such latices may be used individually or in various mixtures of two or more latices. Additional agents may be included to enhance the deposition and the retention of such resinous latex binders on the fibrous materials ro to improve their subsequent chemical and physical properties and characteristics.

The amount of such binder material which is deposited and retained upon the fibrous materials varies widely but normally is in the range of from about 7 percent by weight to about 27 percent by weight, and preferably from about 9 percent by weight to about 23 percent by weight, based on the total weight of the fibrous backing materials.

FORMING

Normally, after the resin binder material has been substantially completely precipitated upon the fibrous materials, it is then pumped, occasionally through a secondary Jordan, and the fiber slurry is diluted with additional water still further until it has a consistency or percent solids concentration in the range of from about ½ percent to about 1 percent. It is then pumped to a standard headbox of a conventional web-forming machine, which can be either a Fourdrinier wire machine, or a cylinder machine, or any other type of web-forming machine, as desired or required, and formed into sheet material of the necessary thickness and weight therein.

The bulk of the slurrying water drains downwardly from the mass of fibrous materials through a moving screen of the web-forming machine and, subsequently, additional water is removed by a conventional press section by being passed under pressure through conventional felts or pressure rolls. The moist sheet is then passed through a conventional drier section where it passes in contact over a number of conventionally heated drying rolls or cans. A substantially dry sheet leaves the last drying can and is normally formed into a roll or is sheeted into size or held for further use or further processing.

The average thickness of the sheet or web of resin bonded fibrous backing material varies according to many factors, notably the percentage consistency or solids content of the fiber slurry as actually deposited on the web forming screen, the volumetric rate at which the fiber slurry is fed to the web forming screen, the linear speed of the web forming screen, and so forth, and normally is in the range of from about 0.010 inch to as much as about 0.180 inch, or even more, as desired or required, depending upon the subsequent intended purpose and future use of the fibrous backing material.

The average width of the sheet or web of fibrous backing material depends essentially upon the width of the particular web formation machine which is used to form the fibrous sheet. Widths of from about 185 inches down to about 30 inches are utilizable within the scope of the present invention, with more commercial widths falling within the range of from about 150 inches down to about 80 inches, with final trimmed widths being slightly less, say from about 147 inches down to about 75 inches.

The fibrous backing sheet is then capable of utilization in many uses, either by itself, or in combination with other sheet materials, notable of such uses being its employment as a fibrous backing material for floor surface coverings. For such a use, the fibrous backing sheet material often has a size or leveling coat initially applied to its surface prior to the application of one or more of the same or different resinous polymeric compositions. Such a coat also serves as a barrier coat or layer to prevent the migration of any of the impregnant or binder in the fibrous backing material into the overlying resinous polymer compositions. In addition, the size coat often serves to provide good adhesion between the base fibrous backing material and the applied first coat of resinous polymeric composition. As pointed out hereinbefore, the layer or layers of resinous polymer compositions are usually polyvinyl chloride homopolymers or copolymer composition and are applied by conventional and standard methods more fully described in greater detail in the previously described U.S. Patents to Nairn et al. Naturally, many other resinous polymeric compositions, such as those mentioned in said U.S. Patents, may be used, as well as many other methods of applying such resinous polymeric compositions to such base resinous fibrous backing sheet materials.

The present invention will be described in greater particularity by reference to the following specific Examples wherein there are disclosed preferred and typical embodiments utilizing certain specific chemical substances and certain specific physical conditions. However, it is to be appreciated that such Examples are primarily illustrative and are not limitative of the broader aspects of the present inventive concept in that other chemical substances and other physical conditions may be employed.

EXAMPLE I

A resilient surface floor covering comprising a layer of a resinous polymeric composition and a dimensionally stable fibrous backing material is prepared as follows:

Into 5000 gallons of water at room temperature is added 16.4 pounds (solids) or a stable, water-soluble, cationic, quaternary modified acrylamide polymer comprising a co-polymer of acrylamide and dimethylaminoethylmethacrylate, quaternized by dimethyl sulfate, having an extremely high molecular weight in the range of 3–5 million (by the intrinsic viscosity method) and a high charge density of about 472 milliequivalents/milligram of unit weight. Such addition and all subsequent additions are made with constant stirring and good agitation to insure a uniform homogeneity.

The following are then added in the order shown:

| | Pounds |
|---|---|
| Water soluble, anionic, synthetic resin strength additive, pH 6 | 73.6 |
| Water soluble, cationic, synthetic resin strength additive, deposition or retention aid, pH 4.6–4.9 | 24.6 |
| Anionic polypropylene fibers, hydrofelting, average length 0.04 inch, average length/diameter 102, preblended and refined with the next constituent prior to addition | 854 |
| Semi-bleached, softwood (spruce) wood pulp fibers anionic charge | 1040 |
| Fiberglass fibers, ¼inch chopped staple, average diameter 0.00035–0.00040 inch, neutral charge | 400 |
| Filler or loading agent (calcium carbonate), 100% through No 325 mesh screen - 44 microns | 1001 |

Cationic conditions are noted after the addition of the quaternary modified acrylamide polymer. The consistency of the slurry is checked at the end of the addition of the constituents and is adjusted to 2.7%.

The slurry is then transferred to a drop chest where the following is added:

| | Pounds |
|---|---|
| Water-soluble, wet strength synthetic resin, deposition or retention aid, cationic, amine polymer - epichlorohydrin adduct, pH 3.5–5.5, activated with caustic soda | 88.3 |

Such addition takes place with constant stirring to insure uniformity and homogeneity. Cationic conditions are noted at the completion of the addition.

The slurry is then transferred to a precipitation tank where the following is added:

| | Pounds |
|---|---|
| Latex binder addition (28% solids) comprising: | |
| Highly anionic carboxylated styrene butadiene rubber latex | 65 |
| Self-cross-linking polyvinyl acetate emulsion, non-ionic | 65 |
| Wax emulsion | 20 |

Note:
150 pounds (solids) of latex binder used per 1350 pounds (solids) of slurry in precipitation tank to provide 10% binder in total product weight.

Such addition takes place with stirring, as usual, to insure uniformity and homogeneity. It is observed that the supernatant liquid is clear. The precipitated slurry is diluted with water to a 3% consistency and is pumped through a Wemco pump, then through a Jordan, then through a mixing chamber for dilution with water to a consistency of ½% and then forwarded to the headbox of a Fourdrinier on the vat of a cylinder web formation machine and formed into a 0.030 inch thick fibrous sheet material. Heating and drying of such a fibrous sheet material is conventional.

A foamable polyvinyl chloride composition having a conventional formulation such as is set forth in detail in Example I of U.S. Pat. No. 3,293,094 to Nairn et al. is applied to the surface of the fibrous sheet material which becomes its fibrous backing material or substrate. Further procedural steps of gelling, printing, heating, blowing or foaming, fusing, drying, and the like are conventional, as described in said United States Patent.

The resulting product finds commercial acceptance as a resilient floor covering. It is cemented to a floor by means of a water-soluble adhesive paste and does not show any signs of buckling or curling upwardly, particularly where adjacent pieces of the resilient floor covering are fitted or joined together. Subsequent exposure to various moisture conditions or to varying temperature situations similarly do not create any signs of buckling or curling upwardly undesirably. The fibrous backing material is sufficiently dimensionally stable.

Note: The acrylamide polymer is added at 0.5% solids; both the synthetic resin strength additives are added at 12.5% solids; the blend of polypropylene fibers and woodpulp fibers is added at 4% solids (4% consistency); the glass fibers and the filler or loading agent are added as is, that is 100% solids; and the amine polymer-epichlorohydrin adduct is added at 20% solids.

EXAMPLE II

The procedures described in Example I are carried out substantially as set forth therein with the exception that the stable, water-soluble, cationic, quaternary modified acrylamide polymer defined therein is replaced by a similar quaternized co-polymer but having an even higher molecular weight in the range of from about 5 million to about 8 million (intrinsic viscosity method). The results of this Example are generally comparable to the results obtained in Example I and the fibrous backing material has a generally comparable satisfactory and acceptable dimensional stability.

EXAMPLE III

The procedures described in Example I are carried out substantially as set forth therein with the exception that the stable, water-soluble, cationic, quaternary modified acrylamide polymer defined therein is replaced by a similar quaternized co-polymer but having a substantially lower molecular weight of only about one hundred thousand (intrinsic viscosity method). The results of this Example are not satisfactory. The glass fibers form clots and clumps which cannot be dispersed satisfactorily and the resulting fibrous backing material is non-uniform and not homogeneous. It is not sufficiently dimensionally stable.

EXAMPLE IV

The procedures described in Example I are carried out sustantially as set forth therein with the exception that the stable, water-soluble, cationic, quaternary modified acrylamide polymer defined therein is replaced by a similar quaternized co-polymer but having a lower molecular weight of about 1 million (intrinsic viscosity method) and a charge density of less than 350 milliequivalents/milligram of unit weight.

The results of this Example are not satisfactory. The glass fibers form clots and clumps which cannot be dispersed satisfactorily. The resulting fibrous backing material is non-uniform and is not homogeneous. It is not sufficiently dimensionally stable as a fibrous backing material for use in a resilient floor covering.

EXAMPLE V

The procedures described in Example I are carried out substantially as set forth therein with the exception that the stable, water-soluble, cationic, quaternary modified acrylamide polymer defined therein is replaced by a similarly quaternized acrylamide polymer but having a high charge density of about 400 milliequivalents/milligram of unit weight. The results of this Example are generally comparable to the results of Example I and the fibrous backing material has a generally comparable satisfactory and acceptable dimensional stability.

EXAMPLE VI

The procedures described in Example I are carried out substantially as set forth therein with the exception that the stable, water-soluble, cationic, quaternary modified acrylamide comprising a copolymer of acrylamide and dimethylaminoethylacrylate is not added to the slurrying water first, but is added last, after the fibers and the other materials have been added. The results of this Example are not satisfactory. The glass fibers form clots and clumps which are not satisfactorily broken up or dispersed by the subsequent addition of the acrylamide polymer. The resulting fibrous backing material is non-uniform and is not homogeneous. It is not satisfactorily dimensionally stable.

EXAMPLE VII

The procedures described in Example I are carried out substantially as set forth therein with the exception that the stable, water-soluble, cationic, quaternary modified acrylamide polymer defined therein is replaced by a polyvinyl chloride polymer having a molecular weight of about 3 million but a charge density of only about below 200. The results of this Example are not satisfactory. The glass fibers form clots and clumps which cannot be opened up or dispersed satisfactorily and the resulting fibrous backing material is non-uniform and is not homogeneous. It is not sufficiently dimensionally stable for use as a backing for a floor surface covering.

EXAMPLE VIII

The procedures described in Example I are carried out substantially as set forth therein with the exception that the proportions of the various constituents is changed as follows:

| | (solids) Pounds |
|---|---|
| Slurrying water (1231 gallons) | 10,340 |
| Quaternary modified acrylamide polymer (0.5% solids) | 10.2 |
| Water soluble, anionic, synthetic resin strength additive | 45.9 |
| Water soluble, cationic, synthetic resin strength additive | 15.3 |
| Polypropylene fibers (4% solids, 4% consistency) | 530 |
| Wood pulp fibers (4% solids, 4% consistency) | 647 |
| Glass fibers (100% solids) | 250 |
| Calcium carbonate (100% solids) | 621 |
| Amine polymer-epichorohydrin adduct (20% solids) | 62.8 |
| Latex binder (28% solids) : (Batchwise, to provide 10% binder) | |
| Carboxylated styrene butadiene | 36.5 |
| Wax emulsion | 5.5 |
| Defoamer | 0.001 |

All above figures, as well as all other comparable figures in pounds, represents figures in pounds solids of real weight of the constituent.

The final product finds commercial acceptance as a resilient floor covering. It is cemented to a floor by means of a water-soluble paste adhesive and does not show any subsequent signs of curling upwardly or buckling undesirably, particularly where the adjacent parts are fitted or joined together. Exposure to various atmospheric conditions of temperature and of pressure do not create any buckling or curling upwardly. The fibrous backing material is considered commercially sufficiently dimensionally stable.

EXAMPLE IX

The procedures described in Example I are followed substantially as set forth therein with the exception that the proportions of the various constituents are changed as follows:

| | (solids) Pounds |
|---|---|
| Slurrying water (2399 gallons) | 20,150 |
| Quaternary modified acrylamide polymer (0.5% solids) | 10.2 |
| Water-soluble, anionic, syn. resin strength resin, (12.5% solids) | 45.9 |
| Water-soluble, cationic, synthetic resin strength additive (12.5% solids) | 15.3 |
| Polypropylene fibers (4% solids) | 530 |
| Wood pulp fibers (4% solids) | 647 |
| Glass fibers (100% solids) | 250 |
| Calcium carbonate (100% solids) | 621 |
| Amine polymer-epichlorohydrin adduct (20% solids) | 28.8 |
| Latex binder (28% solids): | |
| Carboxylated styrene butadiene | 36.5 |
| Wax emulsion | 5.5 |
| Defoamer | 0.001 |

150 pound batch (28% solids) of latex binder composition provides 42 pounds (solids) of binder per batch of 378 pounds (solids) of stock in precipitation tank to create 10% binder in the total fibrous backing material weight.

The results of this Example are generally comparable to the results obtained in Example 1. The fibrous backing material is dimensionally stable and the resilient floor covering is found to be acceptable commercially, showing no signs of buckling or curling upwardly at the edges that are joined or fitted together. The product also passes subsequent tests for varying atmospheric conditions insofar as varying temperature and moisture conditions are concerned.

Although several specific embodiments of the present invention have been described in the foregoing Examples, the same should not be construed as limiting the inventive concept to the specific features mentioned in such Examples but to include various other equivalent features as set forth and covered by the claims appended hereto. It is to be understood that any suitable charges, modifications and variations may be made without departing from the spirit of the invention or its scope.

What is claimed is:

1. A dimensionally stable fibrous sheet material comprising:

from about 0.2% to about 2% of a stable, water-soluble, cationic, quaternary modified acrylamide polymer having a high charge density of at least about 350 milliequivalents/milligram of unit weight and a high molecular weight of at least about 3 million;

from about 17% to about 34% of polypropylene fibers;

from about 6% to about 23% of glass fibers;

from about 20% to about 39% of wood pulp fibers;

from about 15% to about 60% of a filler or loading agent; and from about 7% to about 27% of a synthetic resinous polymeric binder, all percentages being by weight, based on the total weight of said dimensionally stable fibrous sheet material.

2. A dimensionally stable fibrous sheet material as defined in claim 1, wherein said stable, water-soluble, cationic, quaternary modified acrylamide polymer has a high charge density of from about 350 to about 600 milliequivalents/milligram of unit weight.

3. A dimensionally stable fibrous sheet material as defined in claim 1, wherein said stable, water-soluble, cationic, quaternary modified acrylamide polymer has a high molecular weight of from about 3 million to about 8 million.

4. A dimensionally stable fibrous sheet material as defined in claim 1, wherein said filler or loading agent is calcium carbonate.

5. A surface covering comprising:

a dimensionally stable fibrous sheet material comprising from about 0.2% to about 2% of a stable, water-soluble, cationic, quaternary modified acrylamide polymer having a high charge density of at least about 350 milliequivalents/milligram of unit weight and a high molecular weight of at least about 3 million; from about 17% to about 34% of polypropylene fibers; from about 6% to about 23% of glass fibers; from about 20% to about 39% of wood pulp fibers; from about 15% to about 60% of a filler or loading agent; and from about 7% to about 27% of a synthetic resinous polymeric binder, all percentages being by weight, based on the total weight of said dimensionally stable fibrous sheet material; and at least one layer of a resinous polymeric composition applied to and adhered to said dimensionally stable fibrous sheet material.

6. A surface covering as defined in claim 5, wherein said stable, water-soluble, cationic, quaternary modified acrylamide polymer has a high charge density of from about 350 to about 600 milliequivalents/milligram of unit weight.

7. A surface covering as defined in claim 5, wherein said stable, water soluble, cationic, quaternary modified acrylamide polymer has a high molecular weight of from about 3 million to about 8 million.

8. A surface covering as defined in claim 5, wherein said filler or loading agent is calcium carbonate.

9. A method of making a dimensionally stable fibrous sheet material without utilizing asbestos fibers, which comprises: treating a quantity of water with from about 0.2% to about 2% of a stable, water-soluble, cationic, quaternary modified acrylamide polymer having a molecular weight of a least about 3 million and a high charge density of at least about 350 milliequivalents/milligram of unit weight; adding to said pretreated water from about 30% to about 85% of fibers selected from the group consisting of about 17% to about 34% of polypropylene fibers, from about 6% to about 23% of glass fibers, and from about 20% to about 39% of wood pulp fibers, adding from about 15% to about 60% of a filler or loading agent to said treated water; and then adding from about 7% to about 27% of a latex binder, said percentages being by weight, based on the total weight of said deimensionally stable fibrous sheet material; and forming said combination into a dimensionally stable fibrous sheet material.

10. A method as defined in claim 9, wherein the molecular weight of said stable, water-soluble, cationic, quaternary modified acrylamide polymer has a molecular weight in the range of from about 3 million to about 8 million.

11. A method as defined in claim 9, wherein the high charge density of said stable, water-soluble, cationic, quaternary modified acrylamide is in the range of from about 350 milliequivalents/milligram of unit weight to about 600 milliequivalents/milligram of unit weight.

12. A method as defined in claim 9, wherein said stable, water-soluble, cationic, quaternary modified acrylamide polymer is added to said quantity of water in an amount of from about 0.02% to about 0.2% by weight, based on the weight of said quantity of water.

13. A method of making a surface covering comprising: treating a quantity of water with from about 0.2% to about 2% of a stable, water-soluble, cationic, quaternary modified acrylamide polymer having a molecular weight of at least about 3 million and a high charge density of at least about 350 milliequivalents/milligram of unit weight; adding to said treated water from about 30% to about 85% of fibers selected from the group consisting of about 17% to about 34% of polypropylene fibers, from about 6% to about 23% of glass fibers, and from about 20% to about 39% of wood pulp fibers to said treated water; then adding from about 15% to about 60% of a filler or loading agent; and adding from about 7% to about 27% of a latex binder, said percentages being by weight, based on the total weight of said fibers, said filler or loading agent, said latex binder and said stable, water-soluble, cationic, quaternary modified acrylamide polymer; forming said fibers, said filler or loading agent, said latex binder and said combination into a dimensionally stable fibrous sheet material; and applying and adhering a layer of resinous polymeric composition to the one surface of said dimensionally stable fibrous sheet material.

14. A method as defined in claim 13, wherein the molecular weight of said stable, water-soluble, cationic, quaternary modified acrylamide polymer is in the range of from about 3 million to about 8 million.

15. A method as defined in claim 13, wherein the high charge density of said stable, water-soluble, cationic, quaternary modified acrylamide polymer is in the range of from about 350 milliequivalents/milligram of unit weight to about 600 milliequivalents/milligram of unit weight.

16. A method as defined in claim 13, wherein said stable, water-soluble, cationic, quaternary modified acrylamide polymer is added to said quantitu of water in an amount of from about 0.02% to about 0.2% by weight, based on the weight of the quantity of water.

17. A dimensionally stable fibrous sheet material as defined in claim 1, wherein said stable, water-soluble, cationic, quaternary modified acrylamide polymer is a quaternized copolymer of acrylamide and a dialkylaminoalkylacrylate.

18. A dimensionally stable fibrous sheet material as defined in claim 1, wherein said stable, water-soluble, cationic, quaternary modified acrylamide polymer is a quaternized copolymer of acrylamide and a dialkylaminoalkylmethacrylate.

19. A dimensionally stable fibrous sheet material as defined in claim 1, wherein said stable, water soluble, cationic, quaternary modified acrylamide polymer is a quaternized copolymer of acrylamide and dimethylaminoethylmethacrylate.

* * * * *